US006796479B2

(12) United States Patent
Ueno

(10) Patent No.: US 6,796,479 B2
(45) Date of Patent: Sep. 28, 2004

(54) LOOP-PIN ATTACHING DEVICE

(75) Inventor: Hideyuki Ueno, Kanagawa (JP)

(73) Assignee: M.I.T. International Co., Ltd., Yokohama (JP)

( * ) Notice: Subject to any disclaimer, the term of this patent is extended or adjusted under 35 U.S.C. 154(b) by 0 days.

(21) Appl. No.: 10/611,349

(22) Filed: Jul. 1, 2003

(65) Prior Publication Data

US 2004/0056064 A1 Mar. 25, 2004

(30) Foreign Application Priority Data

Jul. 4, 2002 (JP) ..... 2002-195336

(51) Int. Cl.[7] ..... B65C 7/00
(52) U.S. Cl. ..... 227/71; 227/67
(58) Field of Search ..... 227/67, 71

(56) References Cited

U.S. PATENT DOCUMENTS 2,707,783 A * 5/1955 Sullivan ..... 72/409.05
4,533,076 A * 8/1985 Bourque ..... 227/67
5,205,458 A * 4/1993 Kunreuther ..... 227/71
5,678,747 A * 10/1997 Kunreuther et al. ..... 227/71
5,810,238 A * 9/1998 Kunreuther ..... 227/71
6,101,683 A 8/2000 Deschenes et al.
6,267,286 B1 * 7/2001 Deschenes et al. ..... 227/71
6,685,077 B1 * 2/2004 Davignon et al. ..... 227/67

FOREIGN PATENT DOCUMENTS

EP 1 149 770 10/2001

* cited by examiner

*Primary Examiner*—Scott A. Smith
(74) *Attorney, Agent, or Firm*—Greer, Burns & Crain, Ltd.

(57) ABSTRACT

The present invention is to provide a loop-pin attaching device 20 which has a configuration that can easily deal with any troubles which would be occurred in the device 20 such as a malfunction or damage on the device 20 as well as that can flexibly use for any kinds of good to attach a tag thereto, can be provided and in order to attain the above-mentioned object, a loop-pin attaching device 20 of the present invention is provided with a grip lever 22, a first feeding pin 34 and a second feeding pin 42, and wherein the loop-pin attaching device 20 being further provided with a first hollow guide member 43 having a curved configuration and a second hollow guide member 21 having a front end portion 35 directing to a tip end portion 44 of the first hollow guide member 43, both of the first and second hollow guide member 43, 21 being provided on a front end surface of the device, and further wherein the first hollow guide member 43 or the second hollow guide member being attached to the front end surface of the main body 33 of the device 20, detachably.

18 Claims, 15 Drawing Sheets

Fig. 16 (A)
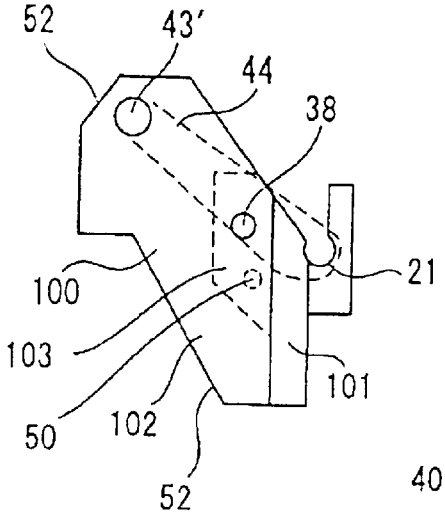
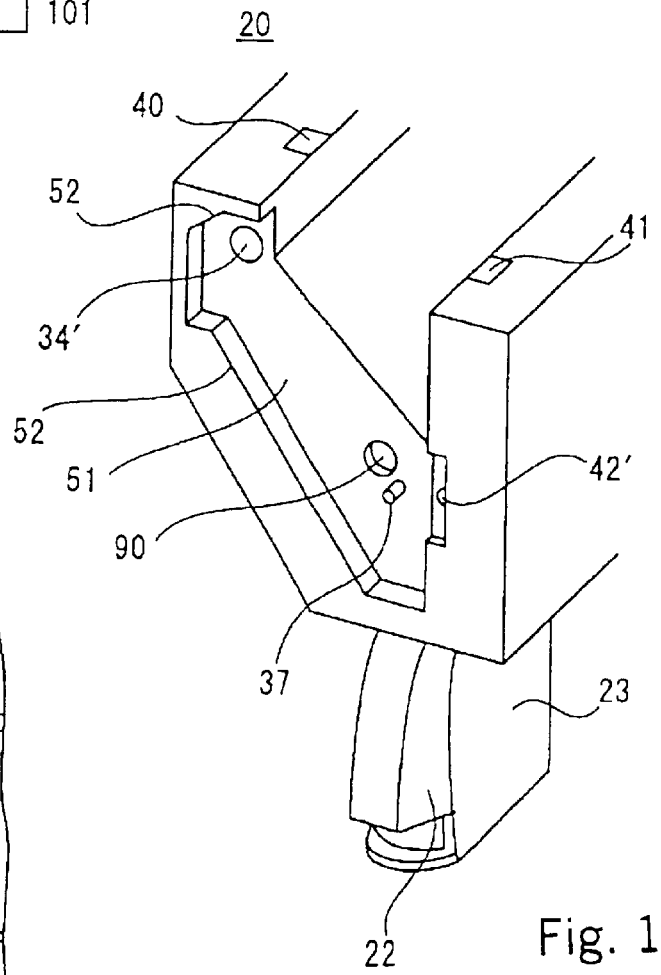
Fig. 16 (B)
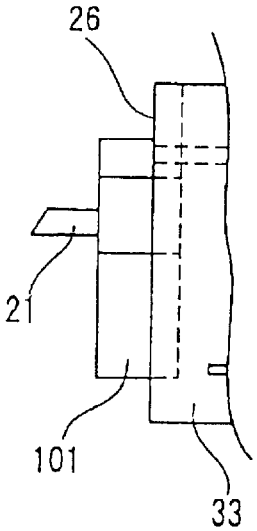
Fig. 16 (C)

LOOP-PIN ATTACHING DEVICE

FIELD OF THE INVENTION

The present invention relates to a loop-pin attaching device which can shot a loop-pin which can bind clothes, socks, or the like or which can attach tags such as brand labels, price tags, material description, instructions or the like to a good by inserting one end portion of an un-looped of the loop-pin into a part of a good and after that by coupling both end portions thereof with each other so as to form a loop.

BACKGROUND OF THE INVENTION

In general, in order to bind clothes, daily small articles, sandals, shoes or the like or to efficiently attach brand labels, price tags or the like to relevant products, various kinds of loop-pins and the loop-pin attaching devices have been used in the past.

A specific configuration of one embodiment of a conventional loop-pin 10 is explained with reference to FIGS. 7 to 11.

As shown in FIG. 7, the loop-pin 10 comprises a flexible filament section 12, an insertion head section 13 equipped with a suitable engagement section 16 located at one end of the filament section 12, and a socket section 15 equipped with a hole 14 for irreversibly passing the insertion head section 13 located at the other end of the filament section 12, wherein the hole 14 being provided with a pair of blade section 17, 17' inside thereof and which can engage with the engagement section 16 of the insertion head section 13.

And further, this conventional loop-pin 10, for example, is made of a synthetic resin material such as ordinal nylon resin, polyester resin or the like and also the insertion head section 13, the socket section 15 and the filament section 12 thereof being integrally molded into one body.

In the above-mentioned embodiment, as shown in FIG. 8, when a desired good, for example a bag 200, is a target good to which a tag should be attached, after the filament section 12 is inserted into a hole 410 previously provided on the tag 400, such as a label or the like, the socket section 15 and a part of the filament section 12, for example, are passed through a space formed between a gripping portion 300 of the bag 200 and a surface of main body of the bag 200 and then the insertion head section 15 is inserted into the hole 14 formed inside the socket section 15 which having a function to hold the tag, so that a predetermined tag 400 can be attached to the good 200 with reducing the filament section 12 into a loop like configuration.

Note that, in the present invention, the above-mentioned loop-pin 10 as shown in FIG. 7 can be used, individually, one by one, but in many cases, in order to improve working efficiency, a loop-pin sheet 600 as shown in FIG. 9 in which a plurality of loop-pins 10 are arranged in parallelism with each other can be used.

Note that as shown in FIG. 9, the sheet of loop-pins 600 has a configuration in that which comprises a plurality of unit loop-pins 10 are arranged adjacently to each other with the respective filament sections 12 being arranged in parallelism to each other, and further, a plurality of the insertion head sections 13 which being also adjacently arranged to each other or portions in the vicinity of the insertion head sections 13 and a plurality of socket sections 15 also being adjacently arranged to each other or portions in the vicinity of the socket sections 15, are connected to each one of a pair of connecting bars 24 and 24', respectively, and the inserting head sections 13 or the portions located near by the inserting head sections 13, and the socket sections 15 or the portions located near by the socket sections 15 are respectively connected to each one of the connecting bars 24 and 24', via joint members 11 and 11'.

In the sheet of loop-pins 600, each one of the unit loop-pins 10 is made of a synthetic resin material such as ordinal nylon resin, polypropylene resin, polyester resin or the like and also the insertion head section 13, the socket section 15 and the filament section 12 thereof being integrally molded into one body.

Further the sheet of loop-pins 600 is mounted on a loop-pin attaching device 20 as shown in FIG. 10 as one embodiment of a conventional loop-pin attaching device and each one of the unit loop-pins 10 can be shot out one by one, respectively, at every time when an operation lever 22 is operated, so that the respective unit loop-pins 10 can be attached to a good with a necessary label.

FIG. 10 shows a condition in that the loop-pin sheet 600 as used in this embodiment is mounted on a loop-pin attaching device 20.

On the other hand, FIG. 11 shows a top plan view of a loop-pin attaching device 20 as used in this embodiment, and it shows that a pair of vertical grooves 40 and 41 into which the above-mentioned connecting bars 24 and 24' of the loop-pin sheet 600, being inserted, respectively, are provided on both side of the loop-pin attaching device 20.

For example, the connecting bar 24' to which the socket sections 15 of the loop-pin sheet 600 are connected, is inserted into the vertical groove 40 while the connecting bar 24 to which the insertion head section 13 of the loop-pin sheet 600 are connected, is inserted into the vertical groove 41.

On the other hand, the loop-pin attaching device 20 as used in this embodiment is provided with a shooting pin 42 which is driven by the operational lever 22 on a side portion of the vertical groove 41 so that the inserting head section 13 is cut off from the joint member 11' connected to the connecting bar 24 and thereafter, it can be pushed out forwardly along an inside pass of the cylindrical hollow needle 21, one by one.

On the other hand, the socket section 15 thereof is pushed out forwardly along an inside pass of the curved cylindrical guide tube portion 43 with a suitable pushing means 25, for example, a pushing means with a gear-rack mechanisms, and thereafter it will meet and be coupled with the inserting head section 13 at a tip end portion 44 of the guide tube portion 43.

However, in the embodiment of the loop-pin attaching device 20 as mentioned above, since the curved cylindrical guide tube portion 43 is fixedly attached to a overall front surface of a main body portion of the loop-pin attaching device 20, there frequently have been occurred some problems in which the socket section 15 of the loop-pin 10 is jammed inside the curved cylindrical guide tube portion 43 or the curved cylindrical guide tube portion 43 has been broken or damaged by a shock when it is applied to the curved cylindrical guide tube portion 43, due to the loop-pin attaching device 20 being fallen down on a floor or due to the loop-pin attaching device 20 being in collision with another component, another device, a desk, a table or the like so as to generate some significant shock.

In this case, in the past, it was necessary to completely replace an over-all main body portion of the current with a new loop-pin attaching device 20 so as to increase the production cost.

Further, in the loop-pin attaching device 20, as shown in FIG. 12, when an operator wishes to attach a tag or the like to a desired good, first, a hole 410 of the tag 400 is engaged with the hollow needle 21 of the loop-pin attaching device 20, and thereafter, by operating the operational lever 22, each one of the filament section 12 of the respective loop-pins 10 is attached to a good 200 by reducing the filament section into a looped configuration.

However, this embodiment has another problem as mentioned hereunder.

Note that, when a projection length of the hollow needle 21 which is calculated from a surface 26 of the loop-pin attaching device 20 to the most tip end portion of the hollow needle 21, is set at the longer value, a distance formed between the tip end portion of the hollow needle 21 and the tip end portion 44 of the curved cylindrical guide tube portion 43 of the loop-pin attaching device 20, which guiding the socket section 15 will be reduced since the tip end portion 44 of the curved cylindrical guide tube portion 43 and the most tip end portion of the hollow needle 21 are oppositely arranged with each other.

Accordingly, in operating this device 20, this fact causes to make it difficult to hook the curved cylindrical guide tube portion 43 in a necessary part of a desired good so that operational work is restricted and working efficiency is reduced.

Note that, in the above-mentioned conventional loop-pin attaching device 20, when a loop-pin is about to be attached to a predetermined good with a tag or the like, the distance formed between the tip end portion of the hollow needle 21 and the tip end portion 44 of the curved cylindrical guide tube portion 43 of the loop-pin attaching device 20, must be set a adequate length met with the good to be labeled.

And thus, it was necessary to previously prepare a plurality of different kinds of the loop-pin attaching devices 20 each having the above-mentioned length being different from each other and to selectively use the one suitable for attaching the loop-pin to the good to be lab led in response to a design of goods.

This caused the operational cost therefore to be greatly increased.

Accordingly, the object of the present invention is to eliminate the above-mentioned past problems and provide a loop-pin attaching device which has constructions which can easily take necessary counter action when troubles such as malfunctions, breakage or the like would be generated and further which can flexibly be applied to any kinds of goods.

SUMMARY OF THE INVENTION

In order to achieve the above-noted object of the present invention, the present invention adopts the following basic technical constitution.

Specifically, a first aspect of the present invention is a loop-pin attaching device for attaching a loop-pin comprising a filament section, an inserting head section provided at one end of the filament section and a socket section provided at the other end of the filament section and equipped with a hole for irreversibly passing the inserting head section therethrough and for holding the inserting head section therein, to a desired good, wherein the loop-pin attaching device being provided with a grip lever ratably pivoted to a grip section of a main body of the device, a first feeding pin for moving the socket portion of the loop-pin in response to an operation of the grip lever and a second feeding pin for moving the inserting head section in response to an operation of the grip lever, and wherein the loop-pin attaching device being further provided with a first hollow guide member having a curved configuration and the first feeding pin being slid through an inside thereof and a second hollow guide member having a front end portion directing to a tip end portion of the first hollow guide member and the second feeding pin being slid through an inside thereof, both of the first and second hollow guide member being provided on a front end surface of the device, and further wherein the first hollow guide member being attached to the front end surface of the main body of the device, detachably.

And a second aspect of the present invention is a loop-pin attaching device for attaching a loop-pin comprising a filament section, an inserting head section provided at one end of the filament section and a socket section provided at the other end of the filament section and equipped with a hole for irreversibly passing the inserting head section therethrough and for holding the inserting head section therein, to a desired good, wherein the loop-pin attaching device being provided with a grip lever rotatably pivoted to a grip section of a main body of the device, a first feeding pin for moving the socket portion of the loop-pin in response to an operation of the grip lever and a second feeding pin for moving the inserting head section in response to an operation of the grip lever, and wherein the loop-pin attaching device being further provided with a first hollow guide member having a curved configuration and the first feeding pin being slid through an inside thereof and a second hollow guide member having a front end portion directing to a tip end portion of the first hollow guide member and the second feeding pin being slid through an inside thereof, both of the first and second hollow guide member being provided on a front end surface of the device, and further wherein the second hollow guide member being attached to the front end surface of the main body of the device, detachably.

In the present invention, since the loop-pin attaching device 20 has the above-mentioned sophisticated technical features, during a time when the device 20 is used, and when the first hollow guide member is broken or the socket section of the loop-pin is jammed inside the first hollow guide member, the first hollow guide member can be easily replaced with a new one under a simple operation.

And further, in the present invention, a suitable second hollow guide member having an adequate hollow needle length can be easily selected in accordance with a configuration, a shape or design of a good to be labeled with the loop-pin and additionally the second hollow guide member can be easily replaced with a new one under a simple operation.

Accordingly, in the present invention, the big disadvantage or big loss as shown in the conventional devices can be effectively avoided in that in the past, the loop-pin attaching device, even a main body of which is still in a condition to be able to be normally used, should be thrown away.

And further, in the present invention, it becomes unnecessary to previously keep a plurality of the loop-pin attaching devices each having the hollow needle the length thereof being different from each other and thus the operational efficiency can be improved as well as the cost for attaching a tag to a good can also be remarkably reduced.

BRIEF DESCRIPTION OF THE DRAWINGS

FIG. 16(A) is a drawing showing a front view of a configuration of an assembled guide portion comprising a first and a second hollow guide portions as used for a loop-pin attaching device as shown in FIG. 13, and FIG. 16(B) is a schematic drawing showing a configuration of front end portion of the loop-pin attaching device of the present invention as shown in FIG. 13 and further FIG. 16 (C) is a side view of a front end portion of one embodiment of the loop-pin attaching device of the present invention;

DESCRIPTION OF THE PREFERRED EMBODIMENTS

A configuration of a preferred embodiment of the loop-pin attaching device of the present invention will be described hereunder with reference to the attached drawings.

Figure 1:
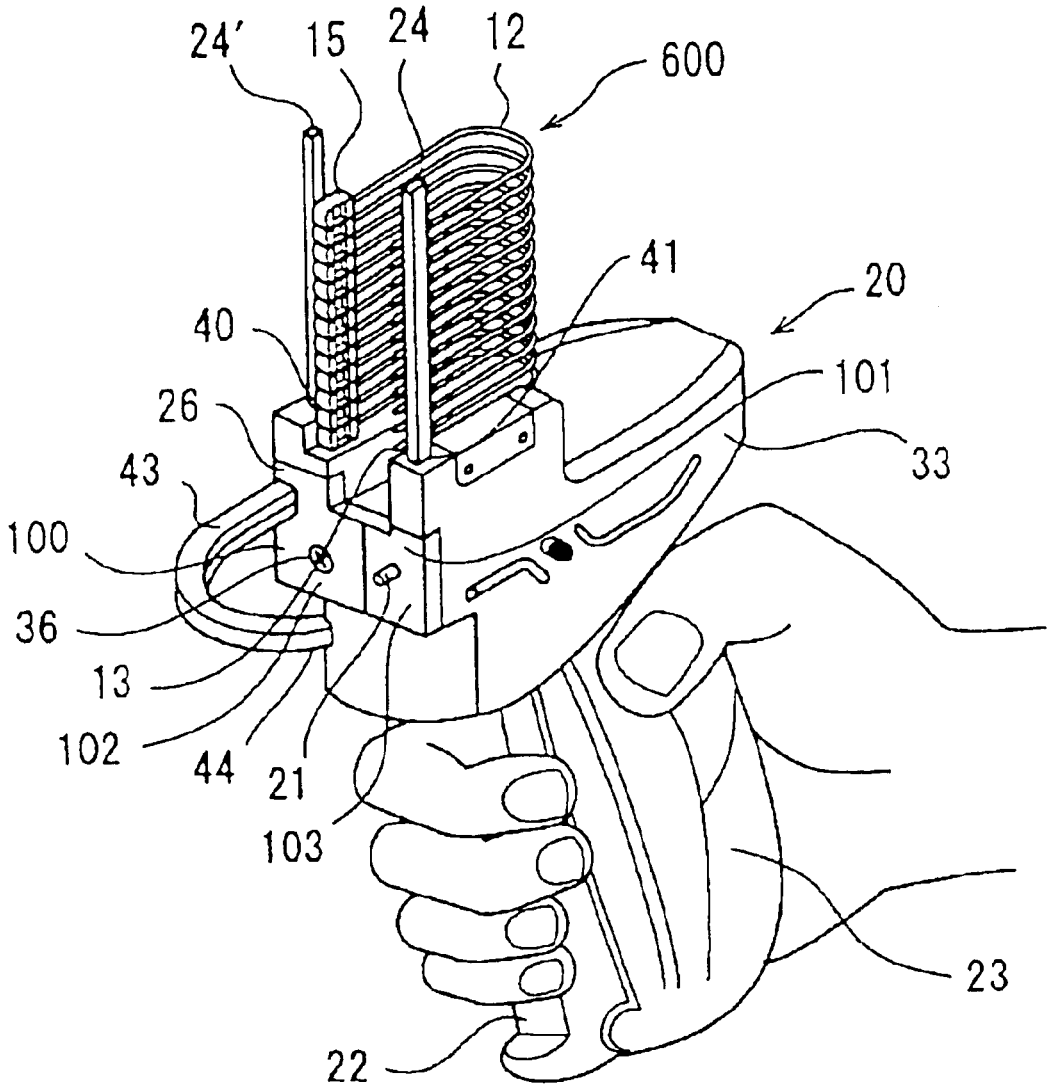
FIG. 1 is a drawing illustrating a configuration of a specific embodiment of a loop-pin attaching device of the present invention.
Figure 2:
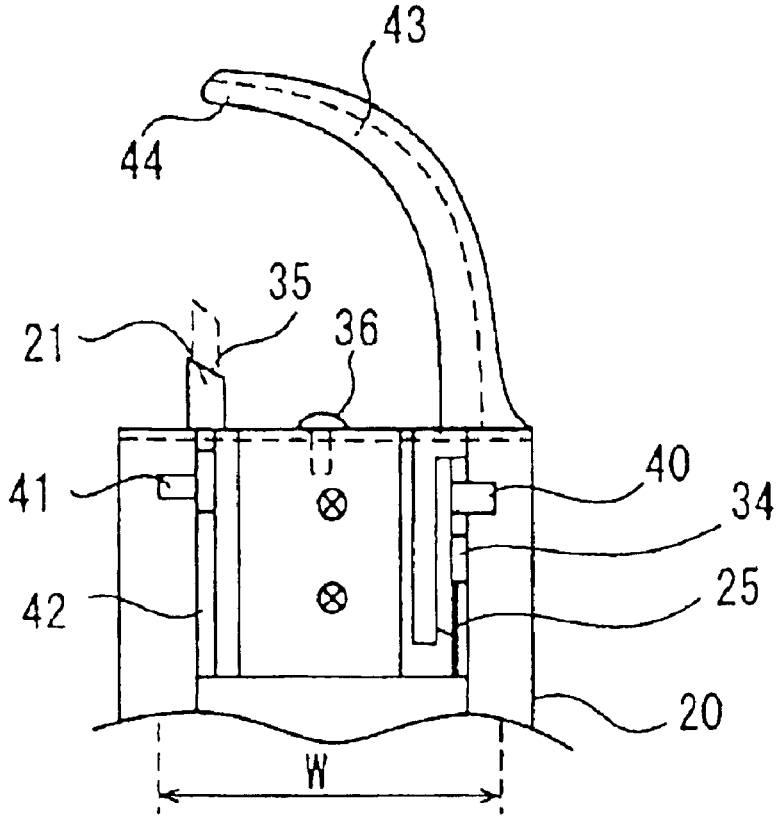
FIG. 2 is a plane view showing a part of a configuration of a specific embodiment of a loop-pin used in the present invention.

FIGS. 1 and 2 show configurations of one specific embodiment of the loop-pin attaching device 20 of the present invention and in these Figs., it is shown a loop-pin attaching device 20 for attaching a loop-pin 10 comprising a filament section 12, an inserting head section 13 provided at one end of the filament section 12 and a socket section 15 provided at the other end of the filament section 12 and equipped with a hole 14 for irreversibly passing the inserting head section 13 therethrough and for holding the inserting head section 13 therein, to a desired good, wherein the loop-pin attaching device 20 being provided with a grip lever 22 rotatably pivoted to a grip section 23 of a main body 33 of the device 20, a first feeding pin 34 for moving the socket portion 15 of the loop-pin 10 in response to an operation of the grip lever 22 and a second feeding pin 42 for moving the inserting head section 13 in response to an operation of the grip lever 22, and wherein the loop-pin attaching device 20 being further provided with a first hollow guide member 43 having a curved configuration and the first feeding pin 34 being slid through an inside thereof and a second hollow guide member 21 having a front end portion 35 directing to a tip end portion 44 of the first hollow guide member 43 and the second feeding pin 42 being slid through an inside thereof, both of the first and second hollow guide member 43, 21 being provided on a front end surface of the device, and further wherein the first hollow guide member 43 being attached to the front end surface of the main body 33 of the device 20, detachably.

Figure 10:
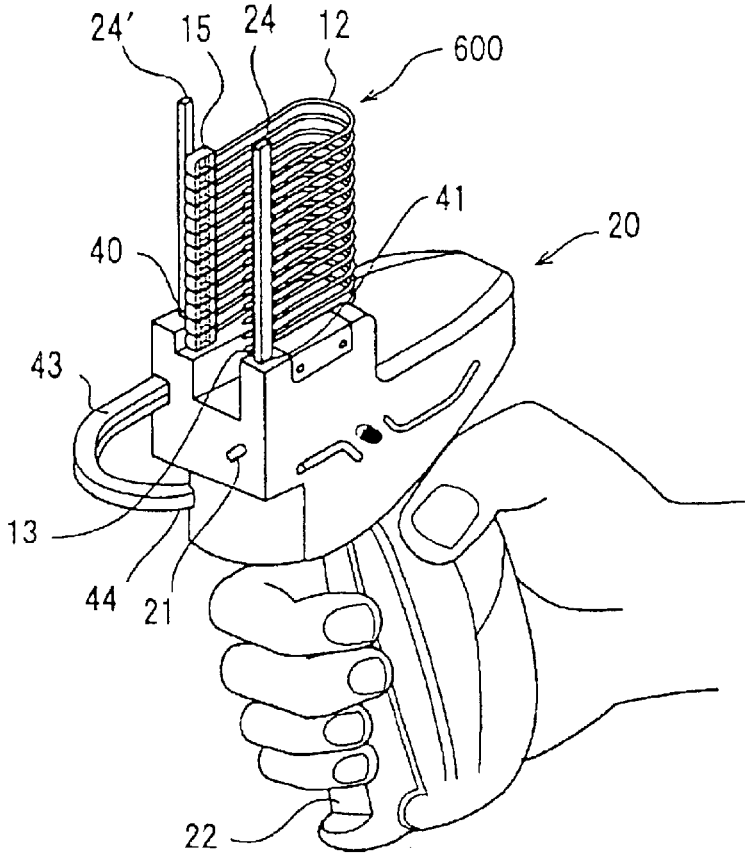
FIG. 10 is a drawing showing a configuration of a conventional loop-pin attaching device.

Note that since the precise configuration of the loop-pin attaching device 20 of the present invention may be substantially identical to that of the conventional device as shown in FIG. 10, the detailed explanation about the loop-pin attaching device 20 of the present invention is omitted.

In the loop-pin attaching device 20 of the present invention, in addition to the configuration of the main body 33 of the loop-pin attaching device 20, it is preferable that the second hollow guide member 21 is also detachably attached to the main body 33.

Note that it is also preferable in the loop-pin attaching device 20 of present invention, both of the first hollow guide member 43 and the second hollow guide member 21 are detachably attached to the main body 33.

The first hollow guide member 43 and/or the second hollow guide member 21 both of which can be used for the loop-pin attaching device 20 of the present invention, are preferably made of either one of a metallic material and a synthetic resin material.

Especially, as explained hereunder, the second hollow guide member 21 is preferably made of a metallic material, since the second hollow guide member 21 which is formed to have a hollow needle configuration, is necessary to be formed with a length thereof being desirably changed.

Figure 3:
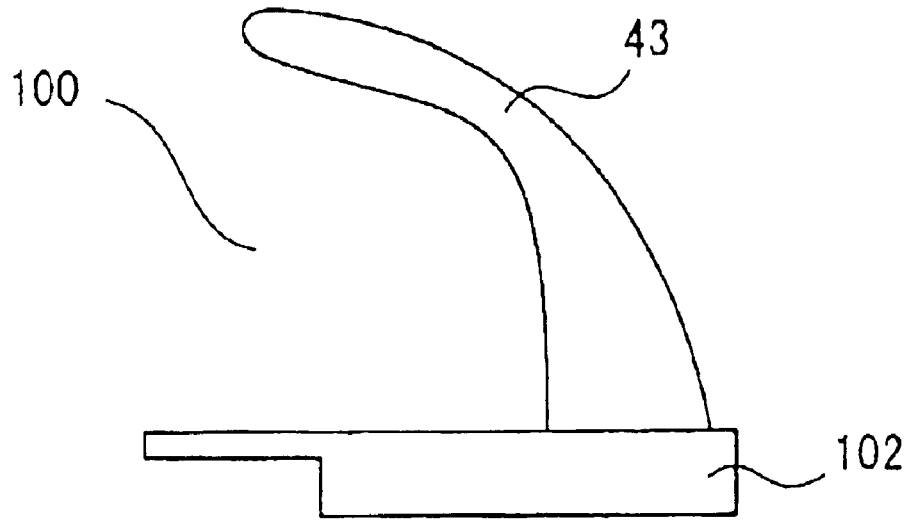
FIG. 3 is a plane view showing one embodiment of a first hollow guide member of the present invention.

On the other hand, the first hollow guide member 43 which can be used for the loop-pin attaching device 20 of the present invention is preferably formed so as to provide a first hollow guide member construction 100 which has a first attaching member 102 integrally formed with the hollow guide member 43 as shown in FIG. 3.

In the first hollow guide member construction 100, it is desirable that the first hollow guide member 43 and the first attaching member 102 are integrally formed into one body, utilizing a molding method with synthetic material, for example.

Figure 4:
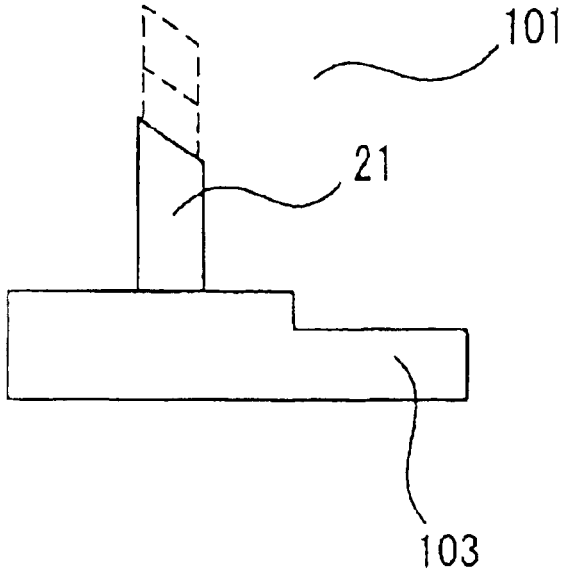
FIG. 4 is a plane view showing one embodiment of a second hollow guide member of the present invention.

On the other hand, as shown in FIG. 4, the second hollow guide member 21 is preferably formed so as to provide a second hollow guide member construction 101 having a second attaching member 103 integrally formed with the second hollow guide member 21.

In the second hollow guide member construction 101, It is desirable that the second hollow guide member 21 and the second attaching member 103 are integrally formed into one body utilizing a molding method, for example, with metallic material or synthetic material.

Figure 5:
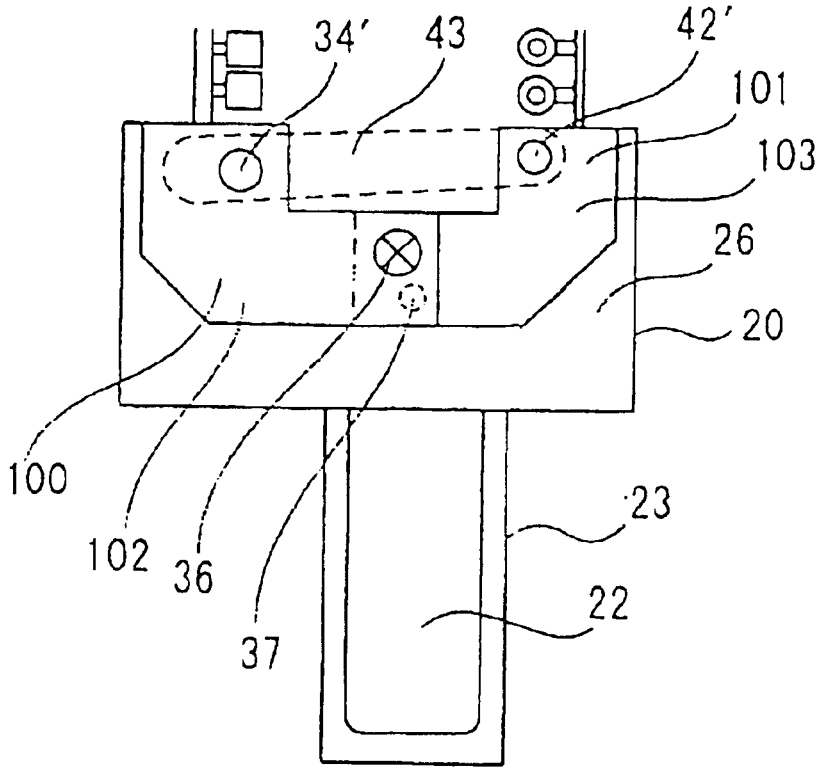
FIG. 5 is a view showing an assembled condition of one specific embodiment of the loop-pin attaching device of the present invention.

Further detailed explanation about the loop-pin attaching device 20 of the present invention will be done hereunder, with reference to FIG. 5.

Note that, an embodiment as shown in FIG. 5 discloses a specific example of the present invention in that the first hollow guide member construction 100 and the second hollow guide member construction 101 as used for the loop-pin attaching device 20 of the present invention, are simultaneously attached to a front end portion 26 of the loop-pin attaching device 20.

In FIG. 5, a part of the first hollow guide member construction 100 having the first hollow guide member 43 and a part of the second hollow guide member construction 101 having the second hollow guide member 21 are overlapped with each other at around a center portion of the front end portion 26 of the loop-pin attaching device 20 and the overlapped portion is fixedly connected to the front end portion 26 of the main body 33 of the loop-pin attaching device 20 with a connecting member 36, for example, a threaded screw or the like.

Figure 6:
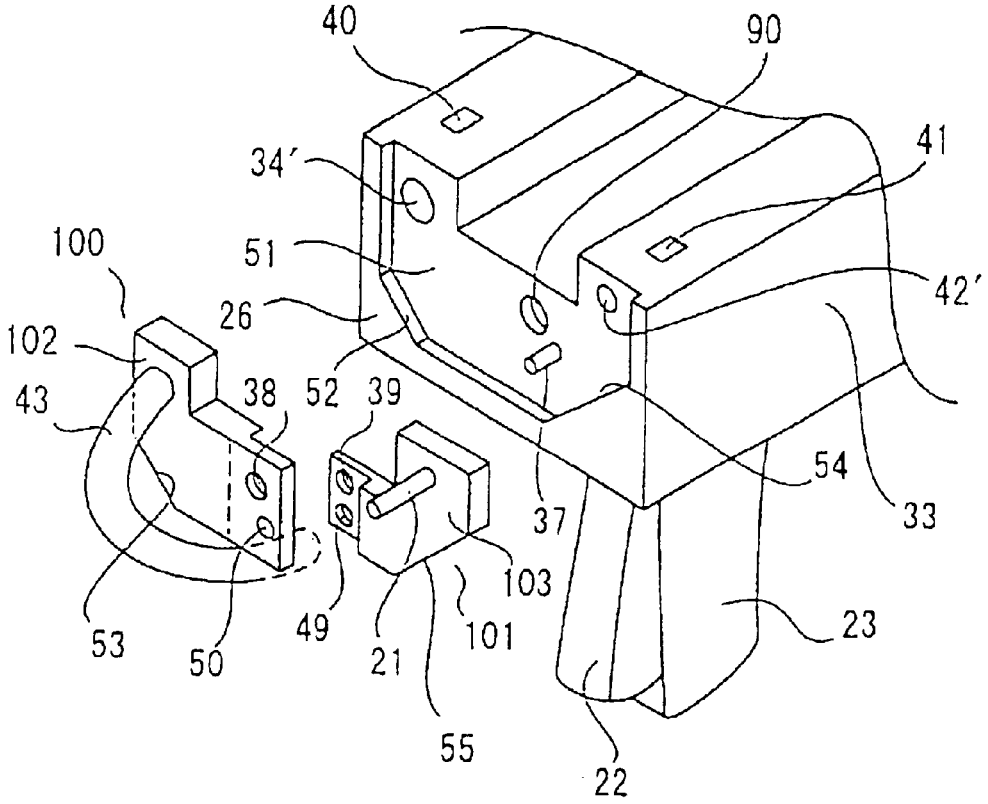
FIG. 6 is a view showing an assembled condition of another specific embodiment of the loop-pin attaching device of the present invention.
Figure 7:
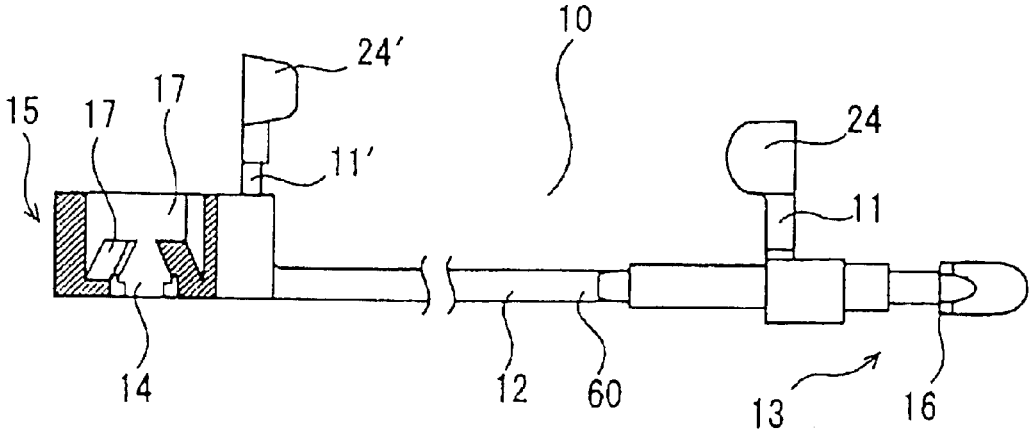
FIG. 7 is a drawing illustrating a configuration of one embodiment of a loop-pin used in the present invention.
Figure 8:
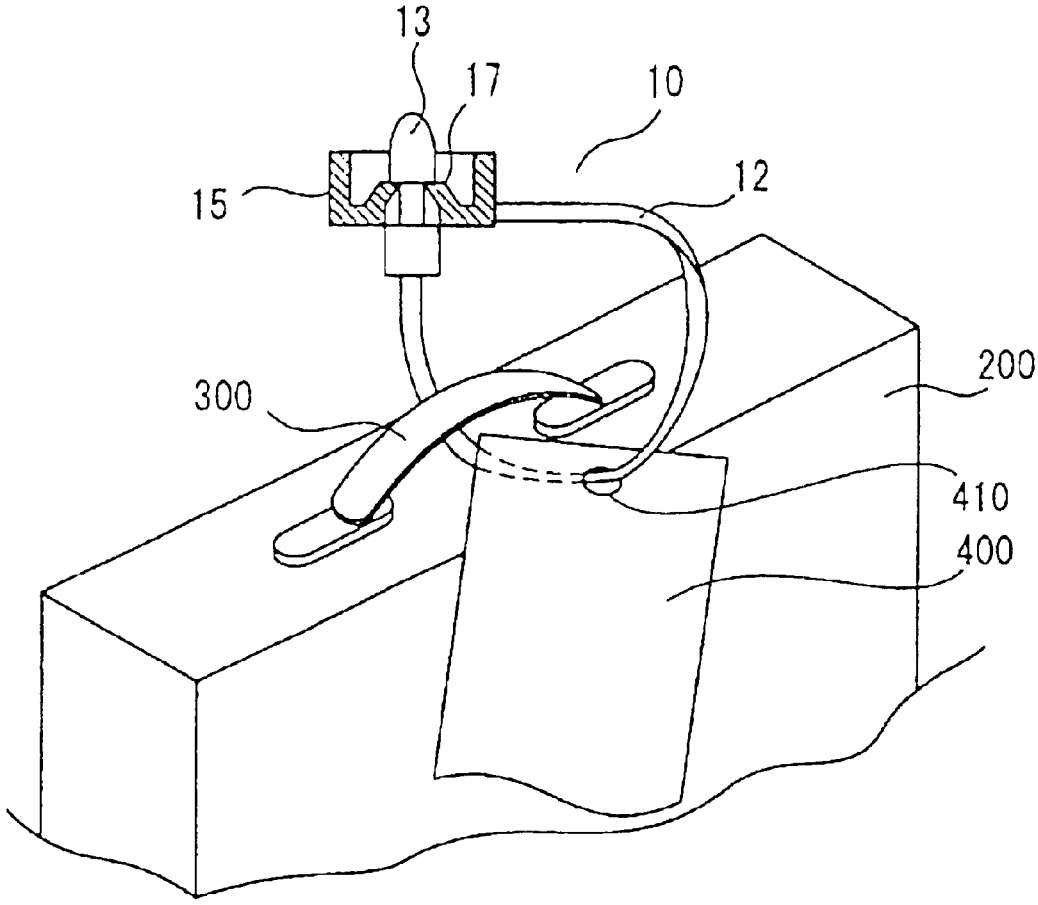
FIG. 8 is a drawing showing how to use the loop-pin as shown in FIG. 7.
Figure 9:
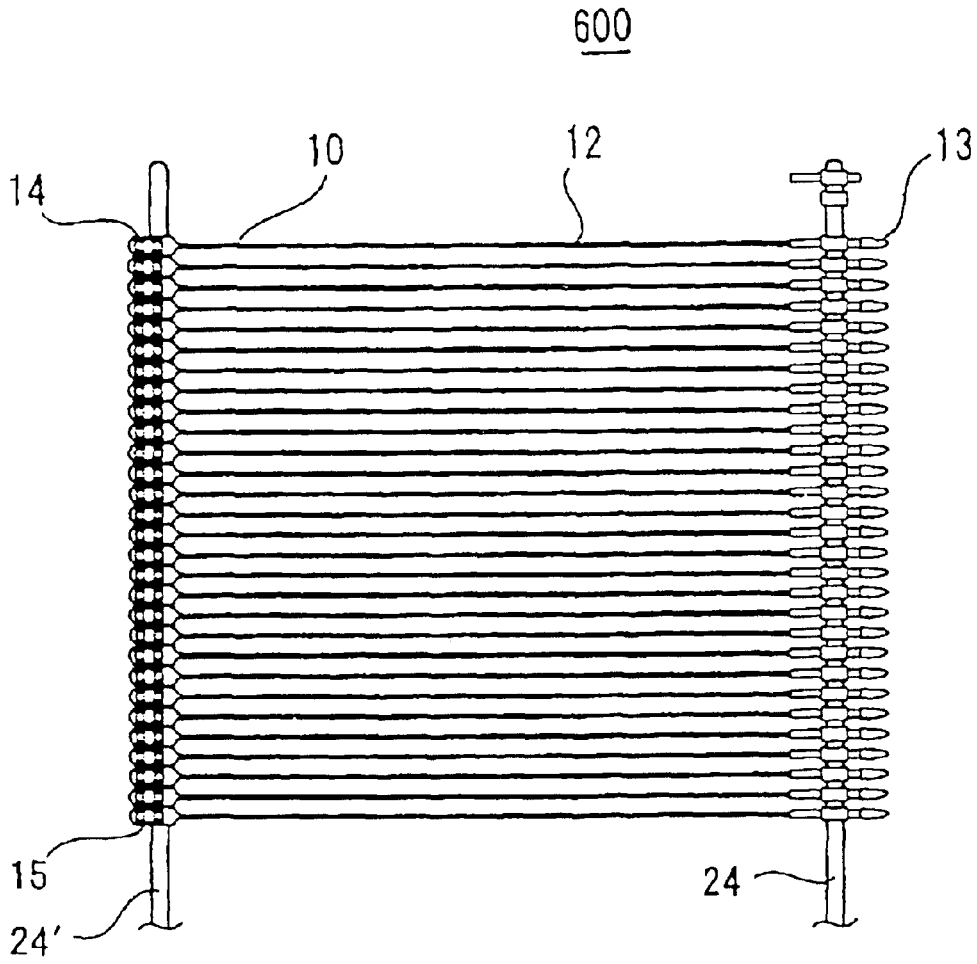
FIG. 9 shows a configuration of one embodiment a loop-pin sheet used in the present invention and in which a plurality of the single loop-pins as shown in FIG. 6 are connected to each other via connecting bars.

In this embodiment, it is preferable that, on the surface of the front end portion 26 of the main body 33 of the loop-pin attaching device 20, a cavity portion 51 as shown in FIG. 6 and having a configuration which can mate with the assembled configuration in that a part of the first hollow guide member construction 100 and a part of the second hollow guide member construction 101 are overlapped with each other, is provided.

Further in this embodiment, in the cavity portion 51, it is desirable that a hole 90 having a screw thread therein which can accept a screw 36 as the connecting member as mentioned above, is provided at a position corresponding to the overlapped portion of both of the first hollow guide member construction 100 and the second hollow guide member construction 101.

And it is further desirable that a positioning pin 37 as the positioning member of the present invention, is provided inside the cavity portion 51 so that both of the first hollow guide member construction 100 and the second hollow guide member construction 101 can be easily inserted into this cavity portion 51.

Accordingly, as shown in FIG. 6, a hole 39 through which the connecting member 36 being penetrated and a through hole 49 through which the positioning pin 37 being penetrated, are preferably provided at a position of a part of the second hollow guide member construction 101 and corresponding to the overlapped portion with a part of the first hollow guide member construction 100.

In addition to this, a hole 38 through which the connecting member 36 being penetrated and a through hole 50 through which the positioning pin 37 being penetrated, are preferably provided at a position of a part of the first hollow guide member construction 100 and corresponding to the overlapped portion with a part of the second hollow guide member construction 101.

Further in this embodiment, in order to make the positioning operation per se more easier, it is desirable that a separate positioning member is provided on a part of the first hollow guide member construction 100 and the second hollow guide member construction 101.

For example, as shown in FIG. 6, a tapered portions 52 and 54 are provided in a part of the cavity portion 51 and a tapered portion 53 which can mate with the tapered portion 52 of the cavity portion 51 is provided on a part of the first hollow guide member construction 100 as well as a tapered portion 55 which can mate with the tapered portion 54 of the cavity portion 51 is provided on a part of the second hollow guide member construction 101.

Note that in the present invention, at least one of the attaching member of the positioning member of the first hollow guide member construction 100 and the second hollow guide member construction 101, preferably has a configuration which can mate with the configuration of the cavity portion 51 formed on the front end portion 26 of the main body 33 of the loop-pin attaching device 20.

Further note that, in FIG. 5, a hole represented by numeral number 34' is a passage through which the first feeding pin 34 sliding back and forth while a hole represented by numeral number 42' is a passage through which the second feeding pin 42 sliding back and forth.

In the present invention, at least a part of at least one of the attaching member of the first hollow guide member construction 100 and the second hollow guide member construction 101 and a part of the cavity portion of the main body of the loop-pin attaching device are preferably provided with a positioning member which can easily specify a position at which each of them are mutually arranged.

With this configuration as mentioned above, in the present invention, the first hollow guide member 43 or the second hollow guide member 21 which serving as the hollow needle can be easily mounted on or dismounted from the main body of the loop-pin attaching device with utilizing only one thread screw which reducing an operation for attaching a tag to a good to be greatly improved as well as the cost for this to be lowered.

In the present invention, the second hollow guide member construction 101 which comprising the second hollow guide member 21 and the second attaching member 103, as mentioned above, is configured so that a height of the hollow needle 21 projected from a surface of the second attaching member 103 can be set at any desirable height and practically, it is preferable that a plurality of the second hollow guide member constructions 101 each having a hollow needle 21 the height thereof being different from each other, for example, at least three or five different kinds of second hollow guide members 101 each having the respective hollow needle having a different height form each other in three or five different steps, are previously produced and they are provided to an user as a set in that they are mixed.

Note that, in the present invention, when an user of the loop-pin attaching device 20 wishes to attach a desired tag to a desired good, efficiency of the tag attaching operation can be improved by selecting the most desirable second hollow guide member construction among the set of the plurality of the second hollow guide member constructions 101 each having a length forming between a surface of the second attaching member and the most end tip portion of the second hollow guide member being different from each other, taking a configuration of a good into account.

Next, another embodiment of the present invention will be explained hereunder with reference to FIGS. 13 to 16.

Figure 11:
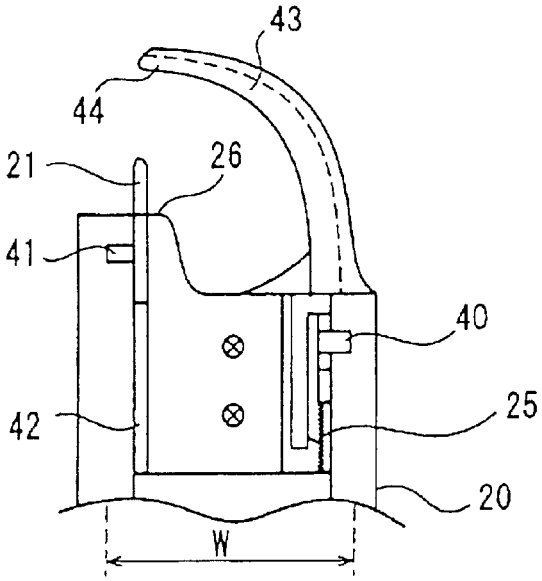
FIG. 11 is a plan view of the conventional loop-pin attaching device as shown in FIG. 10.
Figure 12:
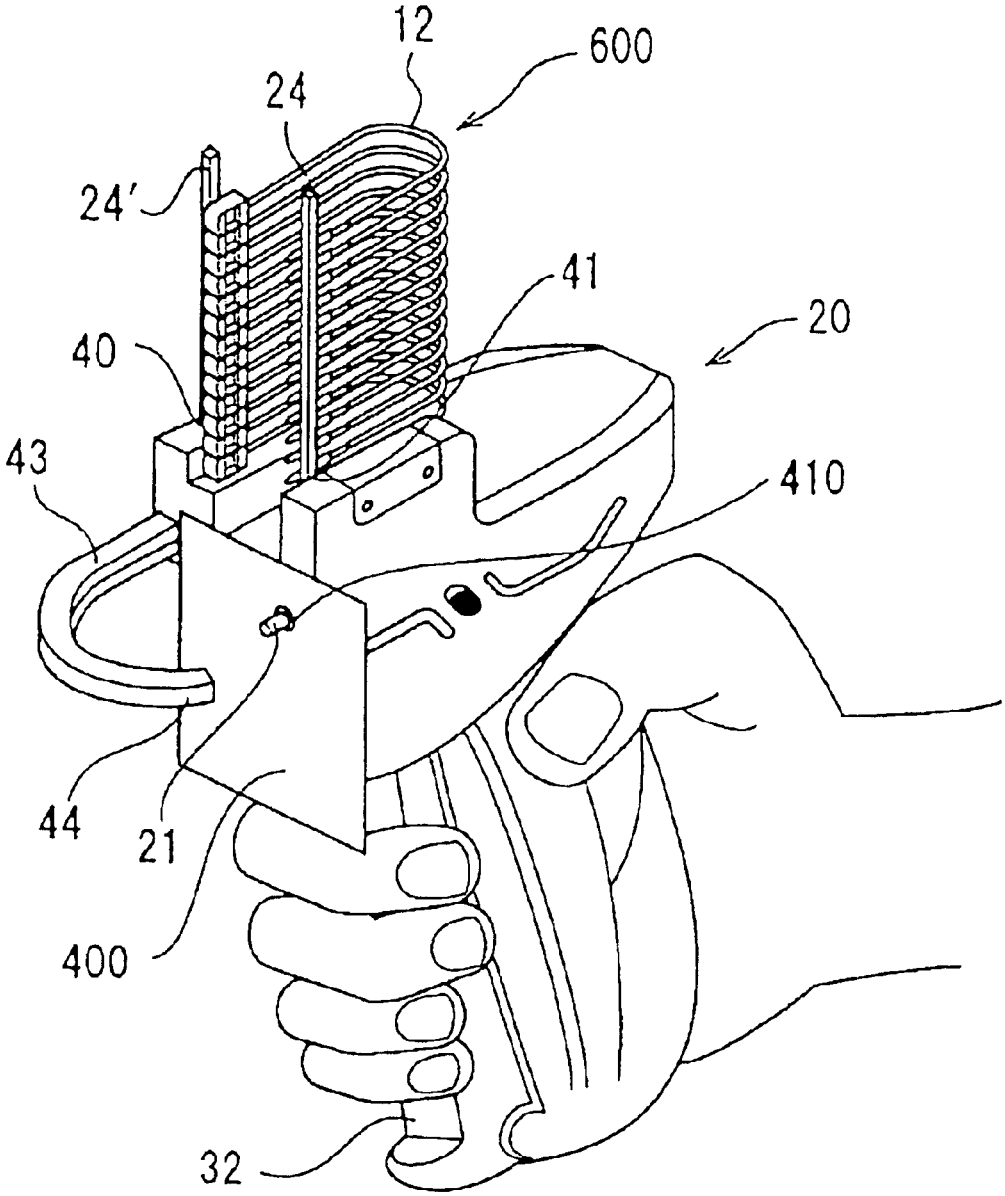
FIG. 12 is a drawing showing how to use the loop-pin attaching device as shown in FIG. 10.
Figure 13:
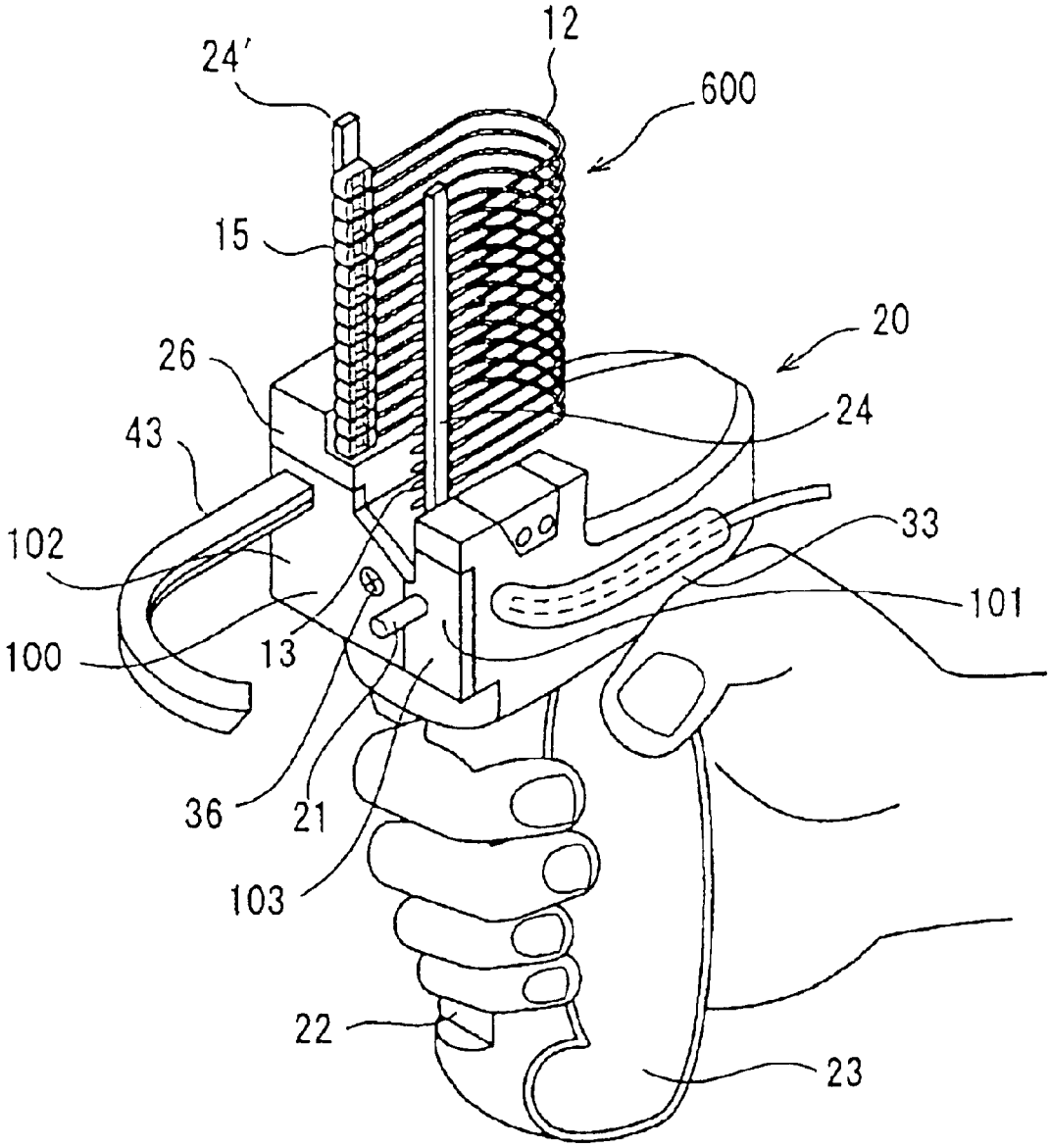
FIG. 13 is a drawing illustrating a configuration of another specific embodiment of a loop-pin attaching device of the present invention.

This embodiment uses a loop-pin attaching device 20 which is identical to the loop-pin attaching device 20 as used in the previous embodiment but especially in this embodiment, in order to minimize a size of the device 20 and to effectively avoid generation of troubles in which when an operation for feeding each one of the loop-pins 10 is carried out by mounting the loop-pin sheet 600 on the loop-pin attaching device 20, the filament sections 12 each being adjacently arranged to each other, are entangled with each other causing the operation of the device 20 into malfunction, as shown in a plan view of the loop-pin attaching device 20 in FIG. 11, a surface on which an inserting slit 41 to which a connecting bar 24 which connects the inserting head section 13, is inserted is formed at surface level lower than a level of a surface on which an inserting slit 40 to which a connecting bar 24' which connects the socket sections 15, is inserted.

Accordingly, a width of the loop-pin attaching device 20 can be greatly narrowed.

Therefore, in the previous embodiment, the curved hollow guide member 43 shows the curved configuration only in a two dimensional phase but in this embodiment, since the above-mentioned configuration are adopted, the curved hollow guide member 43 shows its curved configuration in a three dimensional domain.

Figure 14:
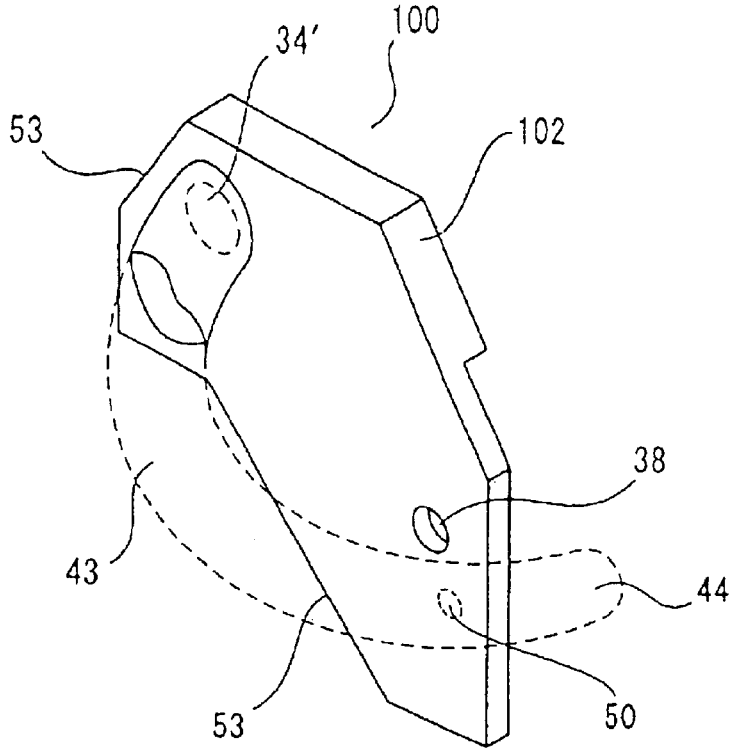
FIG. 14(A) is a schematic view showing one embodiment of the first hollow guide portion including a first attaching member which can be used in the loop-pin attaching device of the present invention as shown in FIG. 13
FIG. 14(B) is a front view of the first hollow guide tube portion including the first attaching member as shown in FIG. 14(A)
Figure 14:
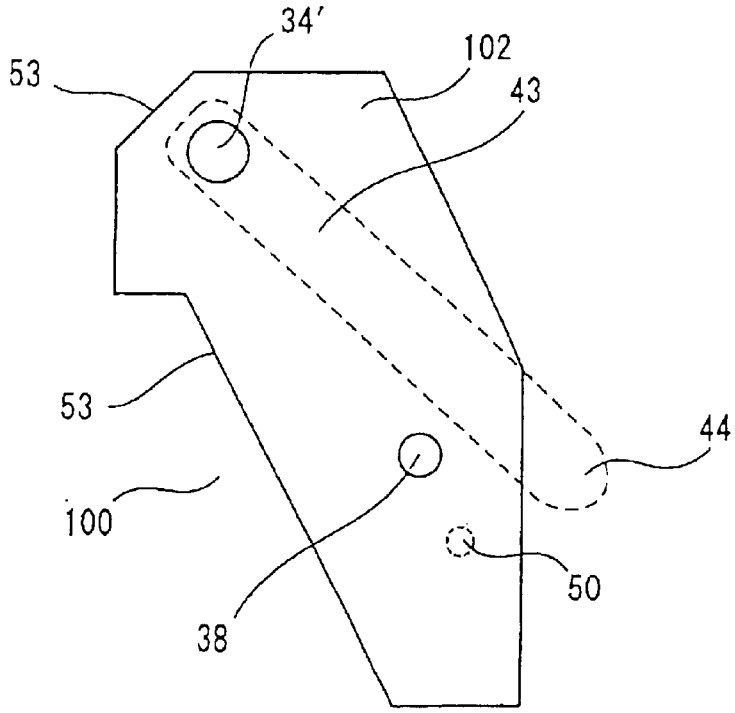
Figure 15:
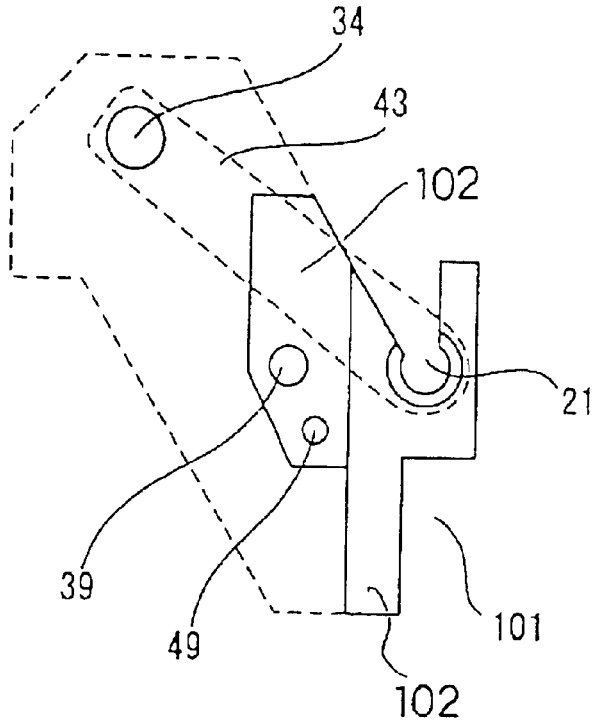
FIG. 15(A) is a front view showing one embodiment of the second hollow guide portion including a second attaching member which can be used in the loop-pin attaching device of the present invention as shown in FIG. 13
FIG. 15(B) is a schematic view showing the second hollow guide tube portion including a second attaching member as shown in FIG. 15(A)
Figure 15:
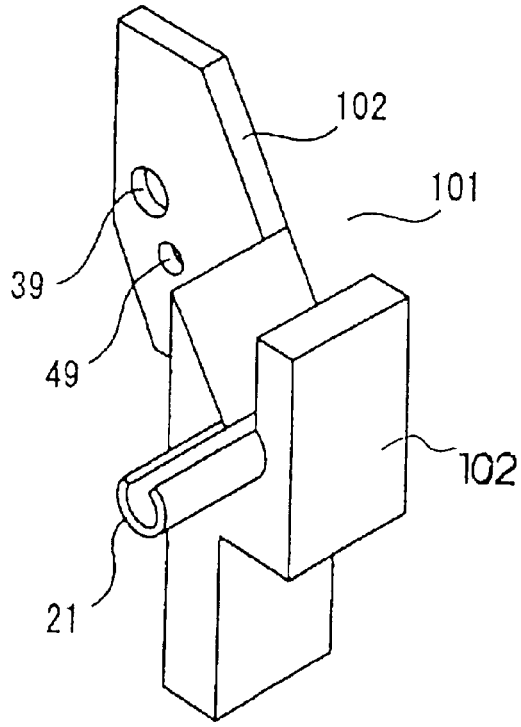

The specific configuration of the first hollow guide member construction 100 of this embodiment is shown in FIG. 14 and since a portion thereof in this embodiment which is identical to a portion of the first hollow guide member construction 100 of the previous embodiment, is assigned the same reference number as used for the same portion of the previous embodiment, detailed explanations thereof are omitted, accordingly.

On the other hand, a configuration of the front end portion of the main body 33 of the loop-pin attaching device 20 and a configuration of the cavity portion 51 are shown in FIG. 16(B), while, as shown in FIG. 16(A), at least a part of the first hollow guide member construction 100 and at least a part of the second hollow guide member construction 101 a mutually overlapped with each other and such assembled constructions are detachably mounted inside the cavity portion 51 with a screw 36.

Note that as apparent from FIG. 16(C), in this embodiment, a right hand side portion of the second hollow guide member construction 101 is only mated with and inserted into the cavity portion 51 formed on the front end portion 26 on the main body 33 and the rest of the portion of the second hollow guide member construction 101 is projected from the surface of the front end portion 26 of the main body 33.

In the present invention, when the second hollow guide member 21 and the second attaching member 103 are integrally formed into one body and when it is fabricated with metallic material, the cost therefor will be increased but on the other hand, since the second hollow guide member shows relatively strong, it is hardly broken, during when a tag attaching operation is carried out, even when an operator forcibly insert the second hollow guide member 21 into a desired hole portion of a desired good or an operator unintentionally impinge the second hollow guide member 21 with a something hard member.

However, when they are integrally formed into one body with synthetic resin material, the cost for producing the same is cheaper but since at least a part of the second hollow guide member is vulnerable, it is necessary to frequently replace the currently used second hollow guide member with a new one due to the second hollow guide member being crushed or broken or bent during its tag attaching operation causing the usage of the loop-pin attaching device 20 impossible.

Therefore, in the second embodiment of the present invention, the second hollow guide member 21 and the second attaching member 103 are formed in a composite form in that a portion thereof is made of metallic material and the rest portion thereof is made of synthetic material.

Figure 17:
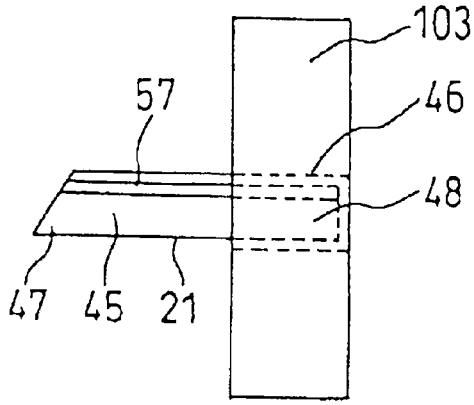
FIG. 17 is a side view of a configuration about one embodiment of a connecting portion formed between the second hollow guide portion and the second attaching member of the present invention.

And further specifically, as shown in FIG. 17, the second attaching member 103 is made of synthetic material while the second hollow guide member 21 is made by a semi circular cylindrical member 45 having a slit portion 57 which is made of metallic material and at least one end portion of the semi circular cylindrical member 45 is inserted into a through hole 46 provided in the second attaching member 103 and solidly fixed therein.

Figure 18:
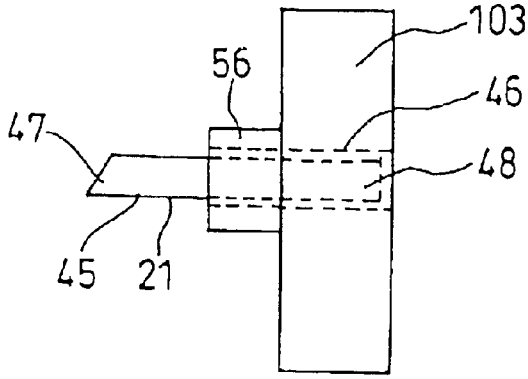
FIG. 18 is a side view of a configuration about another embodiment of a connecting portion formed between the second hollow guide portion and the second attaching member of the present invention.

Or, as shown in FIG. 18, it be formed by a second attaching member 103 having a semi or full cylindrical base portion 56 made by a synthetic resin material and projected integrally from a surface of the second attaching member 103 which is also made by a synthetic resin material and a metallic semi circular cylindrical tube 45 a part of which being mated with and inserted into the semi or full cylindrical base portion 56 and a through hole 46 provided in the second attaching member.

In this case, a first end portion 47 of the semi circular cylindrical member 45 made by metallic material is preferably projected from a tip end portion of the base portion 56, outwardly.

Further, in the second attaching member 103, a through hole 46 having an inner sectional configuration being substantially identical to an inner sectional configuration of the base portion 56 is provided so as to communicate with each other and the second end portion 48 of the metallic semi circular cylindrical member 45 is inserted into the through hole 46 through the base portion 56.

Note that in this embodiment of the present invention, a through hole 46 having an inner configuration being substantially identical to an external configuration of the metallic hollow cylindrical tube 45 or to an inner configuration of the semi or full cylindrical base portion 56 a center axis thereof being co-axial with that of the through hole 46, and further wherein at least a part of the metallic hollow cylindrical tube being fixedly inserted into the through hole 46.

Figure 19:
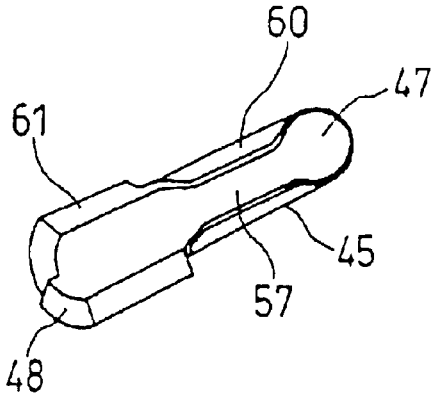
FIG. 19 is a schematic view showing a configuration of one embodiment of the metallic cylindrical portion, which can be used for the second hollow guide portion.

A configuration of one embodiment of the cylindrical member 45 serving as the second hollow guide member 21 made by metallic material is shown in FIG. 19.

In this embodiment, the cylindrical member 45 is formed from a metallic rod having a predetermined diameter by a grinding method or the like so as to be provided with a semi-cylindrical portion 60 with a slit portion 57 and a rear portion 61 which having a semi circular configuration and having a thickness being thicker than that of the cylindrical portion 60.

Figure 20:
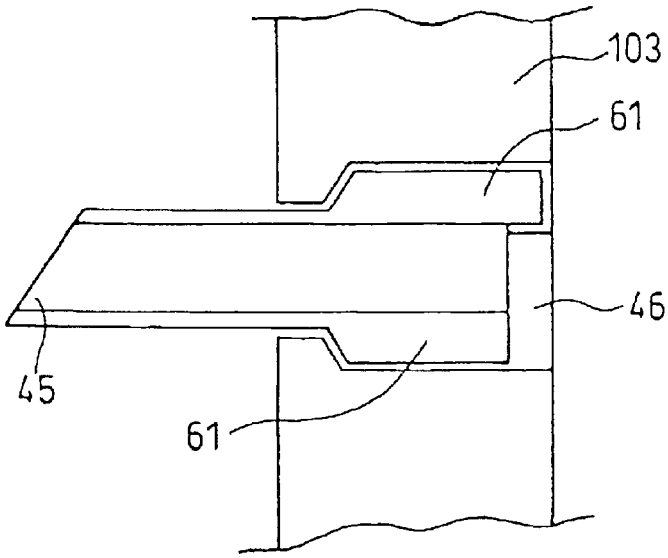
FIG. 20 is a view showing how to use the metallic cylindrical portion as shown in FIG. 19.

And further, as shown in FIG. 20, the cylindrical member 45 is inserted into the through hole 46 provided in the second attaching member 103 and is mated and fixed therein.

In this embodiment, the thick portions can serve as a stopper function by abutting the thick portions thereof at a step like portions which are desirably provided inside the through hole 46 of the second attaching member 103.

Figure 21:
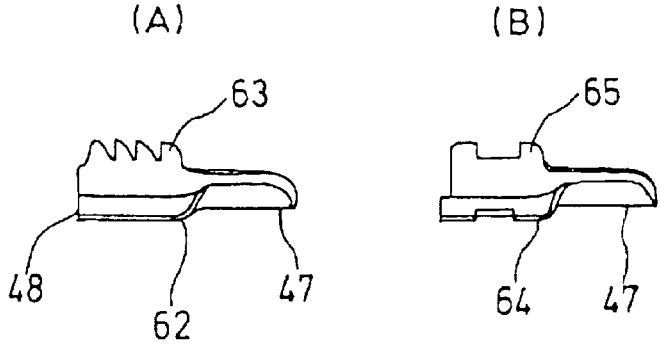
FIG. 21(A) and FIG. 21(B) are schematic views showing configurations of other embodiments of the metallic cylindrical portion which can be used for the second hollow guide portion.
Figure 22:
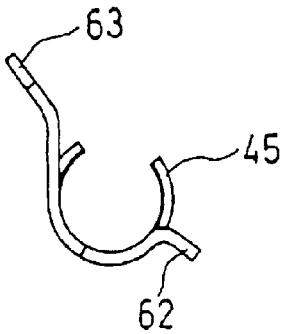
FIG. 22 is a cross-sectional the view of the metallic cylindrical portion as shown in FIG. 21.
Figure 23:
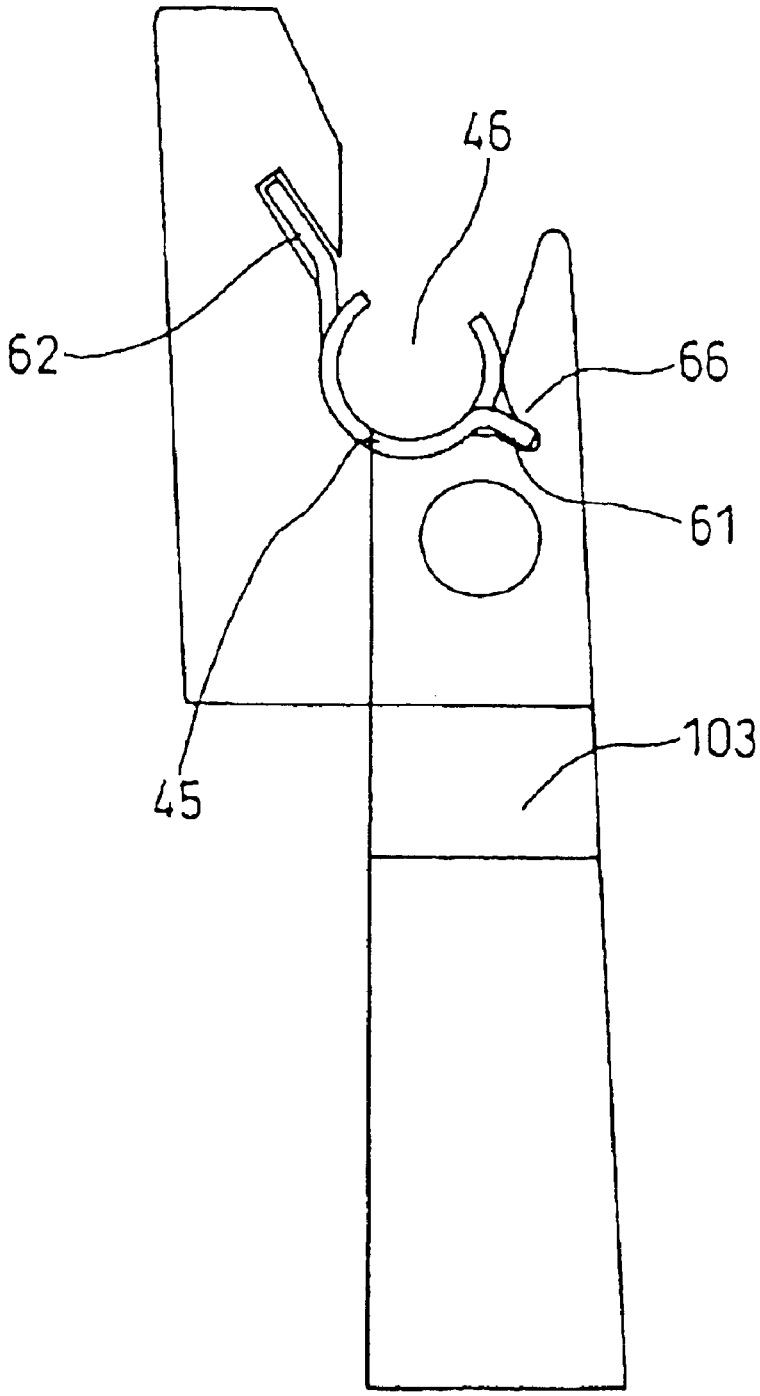
FIG. 23 is a drawing showing how to use the metallic cylindrical portion as shown in FIG. 21.

On the other hand, in another embodiment as shown in FIGS. 21 to 23, a metallic piece member having a desired configuration as shown in FIGS. 21(A) and 21(B) produced from a metallic plate utilizing a punching method or the like and then it is processed with molding method or the like so as to form a semi cylindrical member 45 having therein a slit portion so as to be used for the second hollow guide member.

In this embodiment, at a rear end portion 48 of the metallic semi cylindrical member 45, a projecting members 62, 63, 64 and 65 are provided as shown in FIG. 21 and these projecting members are inserted into a desired slit portions 66 provided on an inner surface of the through hole 46 of the second attaching member 103 so as to use to effect as a stopper.

Note that, as apparent from the above-mentioned explanations about this embodiment, a loop-pin attaching device according to the present invention, the metallic hollow cylindrical tube is provided with a projected member at a desired portion thereof and on an external surface thereof, so that the projected member enabling to be contacted with, an inner surface of the semi or full cylindrical base portion or the through hole formed in the second attaching member.

In the present invention, since the loop-pin attaching device 20 adopts the above-mentioned technical features, the device 20 which has a configuration that can easily deal with any troubles which would be occurred in the device 20 such as a malfunction or damage on the device 20 as well as that can flexibly use for any kinds of good to attach a tag thereto, can be provided.

In addition, in the present invention, since it is possible that a most desired second hollow guide member with a hollow needle having a suitable length, can be selected in response to a configuration or shape of a good to which a label should be attached, and the second hollow guide member can be easily replaced with other one with a simple operation, the big disadvantage or big loss as shown in the conventional devices can be effectively avoided in that the loop-pin attaching device, even a main body of which is still in a condition to be able to be normally used, should be thrown away.

And further, in the present invention, it becomes unnecessary to previously keep a plurality of the loop-pin attaching devices each having the hollow needle the length thereof being different from each other and thus the operational efficiency can be improved as well as the cost for attaching a tag to a good can also be remarkably reduced.

What is claimed is:

1. A loop-pin attaching device for attaching a loop-pin comprising a filament section, an inserting head section provided at one end of said filament section and a socket section provided at the other end of said filament section and equipped with a hole for irreversibly passing said inserting head section therethrough and for holding said inserting head section therein, to a desired good, wherein said loop-pin attaching device being provided with a grip lever rotatably pivoted to a grip section of a main body of said device, a first feeding pin for moving said socket portion of said loop-pin in response to an operation of said grip lever and a second feeding pin for moving said inserting head section in response to an operation of said grip lever, and wherein said loop-pin attaching device being further provided with a first hollow guide member having a curved configuration and said first feeding pin being slid through an inside thereof and a second hollow guide member having a front end portion directing to a tip end portion of said first hollow guide member and said second feeding pin being slid through an inside thereof, both of said first and second hollow guide member being provided on a front end surface of said device, and further wherein said first hollow guide member being attached to said front end surface of said main body of said device, detachably.

2. A loop-pin attaching device for attaching a loop-pin comprising a filament section, an inserting head section provided at one end of said filament section and a socket section provided at the other end of said filament section and equipped with a hole for irreversibly passing said inserting head section therethrough and for holding said inserting head section therein, to a desired good, wherein said loop-pin attaching device being provided with a grip lever rotatably pivoted to a grip section of a main body of said device, a first feeding pin for moving said socket portion of said loop-pin in response to an operation of said grip lever and a second feeding pin for moving said inserting head section in response to an operation of said grip lever, and wherein said loop-pin attaching device being further provided with a first hollow guide member having a curved configuration and said first feeding pin being slid through an inside thereof and a second hollow guide member having a front end portion directing to a tip end portion of said first hollow guide member and said second feeding pin being slid through an inside thereof, both of said first and second hollow guide member being provided on a front end surface of said device, and further wherein said second hollow guide member being attached to said front end surface of said main body of said device, detachably.

3. A loop-pin attaching device according to claim 1 or 2, wherein either one of said first and second follow guided members is made either one of a metallic material and a synthetic resin material.

4. A loop-pin attaching device according to claim 1, wherein said first hollow guide member being provided with a first attaching member which being formed integrally with said first hollow guide member.

5. A loop-pin attaching device according to claim 2, wherein said second hollow guide member being provided with a second attaching member which being formed integrally with said second hollow guide member.

6. A loop-pin attaching device according to claim 1 or 2, wherein at least one of said first attaching member of said first hollow guide member and said second attaching member of said second hollow guide member, is provided with a configuration which being substantially identical to a configuration of an cavity formed on a front end surface of said main body of said device so that said attaching member can mate with and be inserted into said cavity.

7. A loop-pin attaching device according to claim 6, wherein a positioning means is provided on a part of said attaching member of either one of said first and second hollow guide members and on a part of said cavity, which enabling to specify a mutual arrangement position.

8. A loop-pin attaching device according to claim 6, wherein, a part of said first attaching member and a part of said second attaching member are mutually connected to each other so that they can be mated with and inserted into said cavity which is formed on a front end surface of said main body of said device.

9. A loop-pin attaching device according to claim 6, wherein, a part of said first attaching member and a part of said second attaching member are mutually overlapped with each other to thereby both of said attaching members being connected to each other so that they can be met with and inserted into said cavity which is formed on a front end surface of said main body of said device.

10. A loop-pin attaching device according to claim 4 or 5, wherein, at least one of said first attaching member of said first hollow guide member and said second attaching member of said second hollow guide member is attached to a front end surface of said main body of said device via a fixing member.

11. A loop-pin attaching device according to claim 2, wherein, said second hollow guide member is the one selected from a group consisting of a plurality of said second hollow guide members each having a length thereof formed between a surface of said attaching member of said second hollow guide member and a tip end portion of said hollow guide member, being different from each other.

12. A loop-pin attaching device according to claim 5, wherein, either one of said second hollow guide member and said second attaching member or both of them being made by a metallic material and a synthetic resin material, in a composite form.

13. A loop-pin attaching device according to claim 12, wherein, said second hollow guide member is made of a metallic material, while said second attaching member is made of a synthetic resin material and wherein one end portion of said second hollow guide member is directly embedded into a part of said second attaching member.

14. A loop-pin attaching device according to claim 12, wherein, said second hollow guide member consists of a semi or full cylindrical base portion made by a synthetic resin material and projected integrally from a surface of said second attaching member made by a synthetic resin material, and a metallic hollow cylindrical tube a part of which being mated with and inserted into said semi or full cylindrical base portion.

15. A loop-pin attaching device according to claim 14, wherein, another part of said metallic hollow cylindrical tube being projected form a tip end portion of said semi or full cylindrical base portion.

16. A loop-pin attaching device according to any one of claims 12 to 15, wherein a through hole having an inner configuration being substantially identical to an external configuration of said metallic hollow cylindrical tube or to an inner configuration of said, semi or full cylindrical base portion a center axis thereof being co-axial with that of said through hole, and further wherein at least a part of said metallic hollow cylindrical tube being fixedly inserted into said through hole.

17. A loop-pin attaching device according to claim 16, wherein at least a portion of said part of said metallic hollow cylindrical tube being fixedly inserted into said through hole, having a thickness thicker than that of other portion of said metallic hollow cylindrical tube.

18. A loop-pin attaching device according to claim 16, wherein said metallic hollow cylindrical tube is provided with a projected member at a desired portion thereof and on an external surface thereof, so that said projected member enabling to be contacted with an inner surface of said semi or full cylindrical base portion or said through hole formed in said second attaching member.

* * * * *

UNITED STATES PATENT AND TRADEMARK OFFICE

CERTIFICATE OF CORRECTION

PATENT NO. : 6,796,479 B2
DATED : September 28, 2004
INVENTOR(S) : Ueno

It is certified that error appears in the above-identified patent and that said Letters Patent is hereby corrected as shown below:

Title page,
Item [57], ABSTRACT, replace with the following new ABSTRACT:

--The present invention provides a loop-pin attaching device that can easily deal with problems which could occur in the device, such as a malfunction or damage on the device. The device can flexibly be used for any kinds of good to attach a tag thereto. A loop-pin attaching device of the present invention is provided with a grip lever, a first feeding pin and a second feeding pin. The loop-pin attaching device is further provided with a first hollow guide member having a curved configuration and a second hollow guide member having a front end portion directed toward a tip end portion of the first hollow guide member. Both of the first and second hollow guide members are provided on a front end surface of the device, and the first hollow guide member or the second hollow guide member are attached to the front end surface of the main body of the device, detachably.--

Signed and Sealed this

Tenth Day of May, 2005

JON W. DUDAS
*Director of the United States Patent and Trademark Office*